US009093213B2

(12) United States Patent
Shiroki et al.

(10) Patent No.: US 9,093,213 B2
(45) Date of Patent: Jul. 28, 2015

(54) COMMON MODE CHOKE COIL

(71) Applicant: TAIYO YUDEN CO., LTD., Taito-ku, Tokyo (JP)

(72) Inventors: Keiko Shiroki, Takasaki (JP); Takashi Nakajima, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 14/162,396

(22) Filed: Jan. 23, 2014

(65) Prior Publication Data

US 2014/0266545 A1 Sep. 18, 2014

(30) Foreign Application Priority Data

Mar. 15, 2013 (JP) ..... 2013-054296

(51) Int. Cl.
*H01F 5/00* (2006.01)
*H01F 27/28* (2006.01)

(52) U.S. Cl.
CPC ..... *H01F 27/2804* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 6,160,469 | A * | 12/2000 | Liberatore et al. | 336/200 |
| 8,072,143 | B2 * | 12/2011 | Asano et al. | 313/586 |
| 2005/0097726 | A1 * | 5/2005 | Yamamoto et al. | 29/606 |
| 2006/0158301 | A1 * | 7/2006 | Shinkai et al. | 336/232 |
| 2009/0035560 | A1 | 2/2009 | Block et al. | |
| 2011/0181384 | A1 | 7/2011 | Inuduka et al. | |

FOREIGN PATENT DOCUMENTS

| | | | |
|---|---|---|---|
| JP | 03136307 | A * | 6/1991 |
| JP | 2004343084 | A | 12/2004 |
| JP | 2005-310959 | A | 11/2005 |
| JP | 2006303209 | A | 11/2006 |
| JP | 2009522792 | A | 6/2009 |
| JP | 2010232343 | A | 10/2010 |
| WO | 2010044213 | A1 | 4/2010 |

OTHER PUBLICATIONS

A Notification of Reasons for Refusal issued by the Japanese Patent Office, mailed Mar. 3, 2015, for Japanese counterpart application No. 2013-054296.

* cited by examiner

*Primary Examiner* — Tsz Chan

(74) *Attorney, Agent, or Firm* — Law Office of Katsuhiro Arai

(57) ABSTRACT

A common mode choke coil exhibiting greater reliability against moisture load includes a nonmagnetic layer made of glass, magnetic layers placed in a manner sandwiching the nonmagnetic layer, and two or more coil conductors embedded in a base material constituted by the nonmagnetic layer and magnetic layers, wherein Mg segregation is present in the nonmagnetic layer and the Mg segregation accounts for 0.5 to 16 percent of the total area as observed on an electron micrograph of a section of the nonmagnetic layer, while the size of Mg segregation is preferably 0.2 to 10 μm.

3 Claims, 1 Drawing Sheet

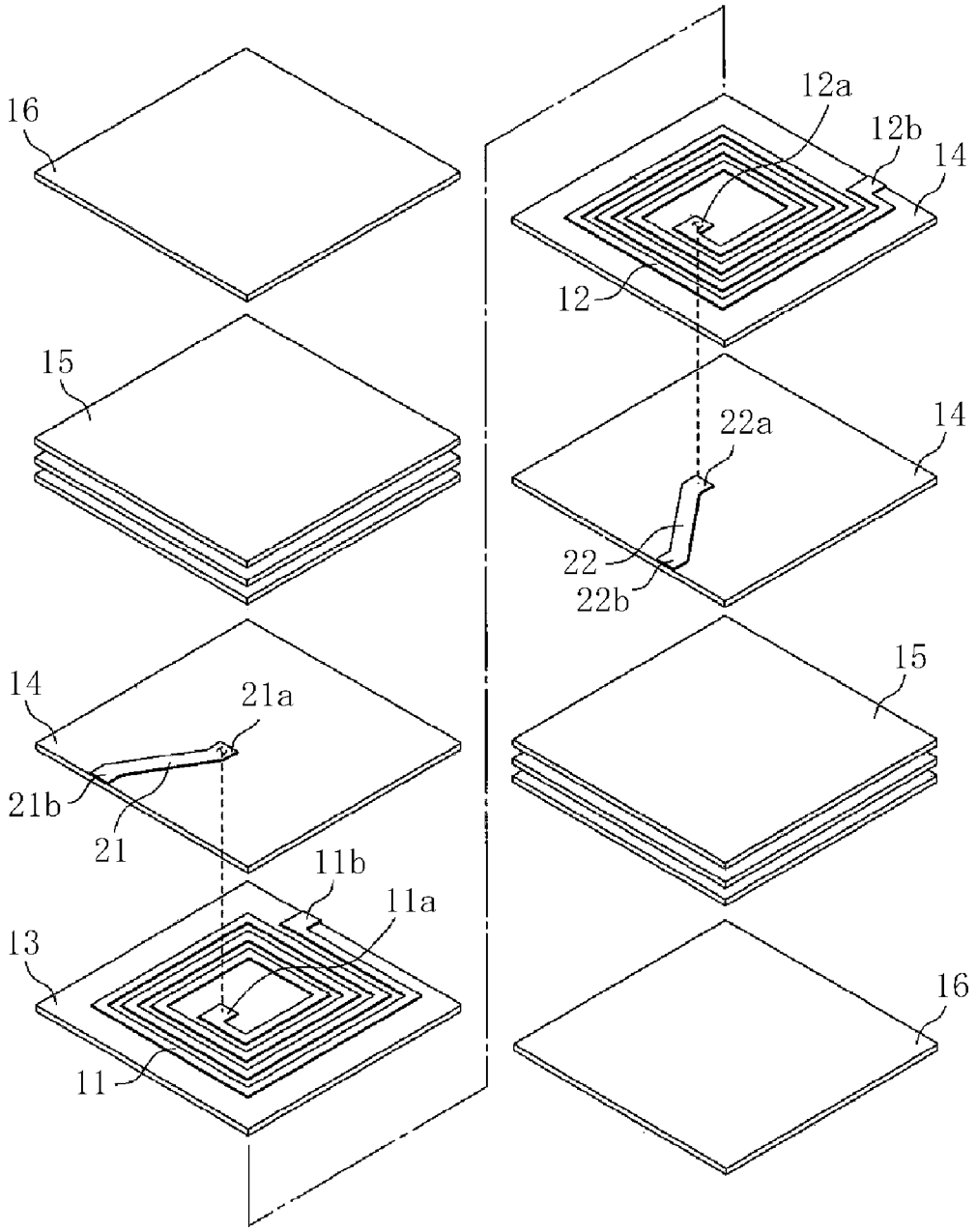
16
15
14
21a
21b
21
11b
11a
13
11
12a
12b
14
12
22a
14
22
22b
15
16

COMMON MODE CHOKE COIL

FIELD OF THE INVENTION

The present invention relates to a common mode choke coil that can be used for various electronic devices.

DESCRIPTION OF THE RELATED ART

A common mode choke coil is an electronic component constituted by two coiled conductors formed on an insulator. In particular, a laminated common mode choke coil is structured in such a way that two spiral conductors face each other with an insulator layer in between. For the insulator layer between the two conductors, glass material can be used favorably, in which case preferably the glass layer that functions as the insulator layer is sandwiched by magnetic layers made of ferrite, etc.

The invention described in Patent Literature 1 is a laminated component combining magnetic sheet and glass sheet, where Ni—Zn is used as the magnetic material while the glass material is based in Si, with Ca, Sr, Ba and Mg contained in the glass material to enhance insulation property. However, such sheet can be as thick as 50 μm, which is far from ideal from the viewpoint of driving thickness reduction.

BACKGROUND ART LITERATURES

[Patent Literature 1] Japanese Patent Laid-open No. 2005-310959

SUMMARY

With any glass material for an electronic component subject to simultaneous sintering with Ag or other electrodes, it is important to control the sintering temperature so that it can be sintered simultaneously with ferrite material. However, densification that results from sintering causes fine pores to remain in the glass layer made of glass material, which leads to drop in insulation reliability as moisture content enters the glass layer through these pores. As electronic components become increasingly smaller and thinner, there is a need to ensure greater reliability of such components and addressing the aforementioned problem presents a vital challenge. In particular, an object of the present invention is to provide a common mode choke coil exhibiting greater reliability against moisture load.

After studying in earnest, the inventors found that presence of Mg segregation of specific pattern in the glass layer reduces fine pores (bubbles) in the glass layer, and completed the present invention as explained below.

The common mode choke coil proposed by the present invention has a nonmagnetic layer made of glass, magnetic layers placed in a manner sandwiching the nonmagnetic layer, and two or more coil conductors buried in a base body comprising the nonmagnetic layer and magnetic layers. Additionally, Mg segregation is present in the nonmagnetic layer, and when a section of the nonmagnetic layer is observed with an electron microscope, preferably the Mg segregation accounts for 0.5 to 16 percent of the total area and preferably the size of Mg segregation is 0.2 to 10 μm.

According to the knowledge gained by the inventors, presence of Mg segregation in the nonmagnetic layer made of glass and present between the two or more coil conductors (hereinafter also referred to simply as "glass layer") reduces bubbles in the glass layer to help achieve high insulation property. To be more specific, reducing the bubbles in the glass layer lessens the permeation of water into the base body, thereby improving moisture resistance.

As a result, the distance between the coils can be shortened, which in turn contributes to thickness reduction. When the Mg segregation present in the glass layer accounts for a percentage ratio in the specific range mentioned above, or more preferably when the size of Mg segregation meets a value in the specified range mentioned above, high levels of insulation property and moisture resistance can be achieved at the same time.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

DESCRIPTION OF THE SYMBOLS

11, 12: Coil conductor, 13: Glass layer, 14 to 16: Magnetic layer

BRIEF DESCRIPTION OF THE DRAWINGS

These and other features of this invention will now be described with reference to the drawing(s) of preferred embodiment(s) which is/are intended to illustrate and not to limit the invention. The drawing(s) is/are greatly simplified for illustrative purposes and is/are not necessarily to scale.

The FIGURE is a schematic exploded view of a common mode choke coil of general structure

DETAILED DESCRIPTION OF EMBODIMENTS

The present invention is described in detail by referring to the drawing as deemed necessary. Note, however, that the present invention is not at all limited to the embodiment illustrated, and because characteristic parts of the invention may be emphasized in the drawing, the scale of each part of the drawing may not be accurate.

The common mode choke coil proposed by the present invention has two or more coil conductors buried in its base body, where normally two coil conductors are provided in a manner opposing each other with a glass layer sandwiched in between. The base body comprises the glass layer and magnetic layers. The FIGURE is a schematic exploded view of a common mode choke coil of general structure, where the coil conductors are denoted by 11 and 12. Preferably the coil conductor draws a curved line that moves away from the center as it turns like a swirl (or moves toward the center as traced in the opposite direction), or polygonal line or other line approximating such curved line. The individual coil conductors may be each formed on roughly the same plane. For the specific shape of coil conductor, any prior art on common mode choke coil can be referenced as deemed necessary. The coil conductor is formed by a conductive material, which is generally a metal, or more specifically Cu, Ag or any alloy containing the foregoing. To allow for sintering in an oxidizing ambience, the coil conductor is preferably made of a conductive material containing Ag, or more preferably made of a conductive material containing Ag by 90 percent by weight or more.

The glass layer is formed in a manner sandwiched by the magnetic layers described later, and preferably the region sandwiched by the two or more coil conductors is made of the glass layer. Favorably the glass layer has a glass material (hereinafter also referred to as "frit" or "glass frit") and quartz ($SiO_2$, which is a crystalline substance) dispersed in the glass material, where preferably the content of quartz in the glass layer is 10 to 35 percent by volume.

Under the present invention, the glass layer contains Mg segregation, which reduces bubbles in the glass layer and makes it difficult for water to permeate into the base body, and consequently improves moisture resistance. Mg may be introduced into the amorphous structure of glass as part of the glass, but Mg segregation is an aggregation of Mg which is not introduced as part of the glass as mentioned above, but which exists independently of the glass as an element constituting an oxide, etc. To be more specific, it can be said that, as the heated glass material is cooled, the faster the densification progresses as a result of sudden contraction of the soft glass, the more bubbles get trapped inside and eventually remain as pores in the glass layer. To keep this from happening, the inventors examined ways to delay the densification of glass material and found that, by adjusting the added amount and particle size of MgO used as a glass layer material, Mg segregation is formed in the material to lessen bubbles/pores. It was also found that the size and occupancy ratio of Mg segregation were correlated with the size and number of bubbles generating in the glass layer. This is probably because, in a condition where areas with Mg segregation and areas without Mg segregation are properly distributed, differential densification could be achieved with the areas without Mg segregation densifying first and areas with Mg segregation densifying later. It is estimated that, as a result of the above, bubbles were pushed out of the glass during the course of densification, and decreased.

Presence of Mg segregation can be identified by TEM (transmission electron microscope) mapping or equivalent methods. The measured common mode choke coil was cut to expose a randomly selected region in the glass layer, with the exposed section polished and observed according to the EPMA (electron probe micro-analyzer) method to confirm presence of Mg in a region (randomly selected) of 0.1 mm×0.1 mm in size. Next, a smaller region (randomly selected) of 5 μm×5 μm in size was focused on in the region where Mg was present, and Mg was mapped by a TEM. The pixels detected as Mg were put through an imaging process to obtain the area and size of where Mg was present. First, the area of Mg can be obtained from the number of pixels recognized as connected or continuous as a result of the imaging process. The percentage of the obtained Mg area to the area of the analyzed region can be obtained as the area ratio of Mg segregation. In addition, the size of Mg can be obtained by converting to a circle the area obtained from the number of pixels recognized as connected or continuous, calculating the diameter of this circle, and defining the maximum value of all diameters obtained as the size of Mg segregation. Note that it is ideal to repeat TEM mapping at least four times, as desired, within a region of 0.1 mm×0.1 mm in size where presence of Mg has been confirmed. In addition, Mg segregation can also be confirmed as a crystalline substance by means of selected-area electron diffraction using a TEM.

Preferably the area ratio of Mg segregation in the measurement described above is 0.5 to 16 percent. Means for enhancing the area ratio include increasing the added amount of MgO used as the raw material, and increasing the particle size of MgO used as the raw material, and adopting any other means having the opposite effect of any of the foregoing means will lead to a drop in the area ratio. So long as the area ratio remains in the range mentioned above, the push-out of bubbles during the course of densification of glass as discussed earlier progresses efficiently. Even more preferably the area ratio of Mg segregation is 1 to 15 percent. By keeping the area ratio in this range, bubbles can be made smaller and the glass layer, thinner.

Preferably the size of Mg segregation in the measurement described above is 0.2 to 10 μm. Means for increasing Mg segregation include increasing the particle size of MgO used as the raw material, and adopting any other means having the opposite effect of the foregoing means will lead to a reduction in the size of Mg segregation. So long as the size of Mg segregation remains in the range mentioned above, the push-out of bubbles during the course of densification of glass progresses efficiently, as mentioned above, instead of the densification being interrupted in any way.

Examples of the glass material constituting the glass layer include borosilicic acid glass whose primary component is $SiO_2$, and non-borosilicic acid glass, among others. The glass layer may contain any alkali metal, alkali earth metal, Al, Cu, Zn, Sn, Fe, Ni, Co, Ag, etc., in addition to the key components of silicate and boron.

If the glass layer contains boron, the content of boron in the glass material is preferably 10 to 30 percent by weight as the content of $B_2O_3$. If the glass layer contains an alkali metal, the content of this alkali metal in the glass material is preferably 0.5 to 4 percent by weight as the content of the oxide of such alkali metal. If the glass layer contains aluminum, the content of aluminum in the glass material is preferably 0.05 to 5 percent by weight as the content of $Al_2O_3$.

The glass layer may be spiked with $ZrO_2$ as an accessory component, where adding just enough $ZrO_2$ to permit observation of $ZrO_2$ segregation at the time of densification makes it possible to prevent the denseness from dropping even in the presence of abundant Mg segregation, which in turn allows for further expansion of the range of the amount of MgO to be added. In addition, $ZrO_2$ is confirmed to be a crystalline substance.

The thickness of the glass layer can be set as deemed appropriate according to the size design, etc., of the common mode choke coil, where examples of this thickness include, but are not limited to, 5 to 25 μm or so.

The common mode choke coil proposed by the present invention has magnetic layers in a manner sandwiching the glass layer. The magnetic layers only need to have stronger magnetism than the glass layer and may be constituted by any one of various ferrites that has been sintered. For the material, constitution, and other properties of the magnetic layers, any suitable background art on common mode choke coil can be referenced as deemed appropriate. For example, the same glass material used for the aforementioned glass layer can be used to constitute layers that directly contact the coil conductors, and magnetic layers can be provided outside these direct contact layers. In the FIGURE, multiple layers denoted by 14, 15 and 16 are illustrated outside the coil conductors 11, 12. These multiple layers are assumed to be any combination of glass and magnetic layers as deemed appropriate, so long as each glass layer is sandwiched by magnetic layers, and the number of layers or the material or thickness of magnetic layers does not limit the scope of the present invention in any way.

In addition to the foregoing, the common mode choke coil 10 proposed by the present invention can have any one of various constitutions made possible by applying any suitable background art by analogy as deemed appropriate. For example, external terminals or wirings that electrically connect such external terminals and the coil conductors 11, 12 may be provided, although not illustrated in the FIGURE.

As for the manufacturing method of common mode choke coil, any prior art can be applied by analogy as deemed appropriate, except that Mg segregation must be present in the glass layer somehow. An example of manufacturing method is described below, but the manufacturing method is not limited to this example in any way. A slurry or paste is prepared by mixing a magnetic material, glass material or other material for each of the layers shown in the FIGURE, with a resin (binder), to prepare sheets 13 to 16 corresponding to the respective layers.

To manufacture the glass layer 13 sandwiched by the coil conductors 11, 12, one general method is to obtain a slurry by mixing crushed glass material with a binder in the presence of a solvent. As the means for crushing glass material, a bead mill or any other known crusher can be applied. The d50 value of crushed glass material is preferably 3 μm or less, or more preferably 1.5 μm or less, while the lower limit is not specified but preferably 0.5 μm. Green sheets can be obtained from the resulting slurry using the doctor blade method, etc.

Next, coil conductor patterns are formed on the green sheets. Coil conductor patterns can be formed by printing on the green sheets a paste, etc., containing silver powder or other material for coil conductor.

Of the opposing coil conductors 11, 12, at least one (the coil conductor 11 in the FIGURE) is preferably formed on the green sheet for glass layer 13. The green sheet 14 on which the other coil conductor 12 is formed may be a glass layer or magnetic layer, or it may be made of any other material, either magnetic or nonmagnetic.

When forming the coil conductors 11, 12, via holes 11*a*, 21*a*, 12*a*, 22*a* and external terminals 11*b*, 21*b*, 12*b*, 24*b* can be formed as deemed appropriate, where any prior art may be applied as deemed appropriate for the methods of forming these holes and terminals.

Furthermore, green sheets for the outer magnetic layers 15, 16, etc., are manufactured using certain materials, respectively, after which the sheets are stacked and sintered. When sintering, it is desired the rate of rise in temperature be controlled to a range of 300 to 1200° C./h. The sintering temperature can be changed as deemed appropriate according to the material, and may be set to around 900° C., for example.

EXAMPLE

The present invention is explained more specifically below using an example. It should be noted, however, that the present invention is not at all limited to the embodiments described in this example.

(Material for Glass Layer)

As the material for the glass layer, 80 percent by volume of glass frit, prepared by 75.4 percent by weight of $SiO_2$, 18.1 percent by weight of $B_2O_3$, 1.8 percent by weight of $K_2O$, 2.6 percent by weight of $Al_2O_3$, and 2.0 percent by weight of MgO in equivalent oxides, and 20 percent by volume of quartz, were used. The ingredients were crushed to 1.5 μm (value of d50) in a bead mill. $ZrO_2$ balls, $Al_2O_3$ balls, etc., can be used as a crushing medium, and $ZrO_2$ balls were used in this example. Dispersant was added as necessary. Ethanol, toluene, methyl ethyl ketone, etc., can be used as a dispersion medium, for example, and ethanol was used in this example. Note that in each example/comparative example, the amount and size of material MgO were changed as shown in Table 1, while the relative blending ratios of all components other than MgO were kept constant in all examples and comparative examples.

It should be noted that, when MgO was added by more than 17 percent by weight, not only did the amount of Mg segregation increase, but densification of glass as a whole was also suppressed, and insufficient strength and other problems began to manifest.

(Manufacturing of Green Sheet for Glass Layer)

A slurry was obtained by mixing and kneading 100 parts by weight of the above material, 300 parts by weight of solvent, 200 parts by weight of binder, and dispersant and plasticizer, and a green sheet was obtained from this slurry using the doctor blade method. $ZrO_2$ balls, $Al_2O_3$ balls, etc., can be used as a mixing medium, and $ZrO_2$ balls were used in this example. Polyvinyl butyral resin, methacrylate resin, etc., can be used as binder, for example; dibutyl phthalate, dioctyl phthalate, etc., can be used as plasticizer, for example; and ethanol, toluene, methyl ethyl ketone, etc., can be used as solvent, for example; and dispersant may be added, as necessary. In this example, polyvinyl butyral resin was used as binder, dibutyl phthalate was used as plasticizer, and ethanol was used as solvent.

(Formation of Coil Conductor Patterns)

Next, a conductive paste containing Ag conductor metal was printed on the obtained green sheet by means of screen printing, etc., to form spiral conductors and conductors to be connected to the external terminals. The spiral conductors and conductors to be connected to the external terminals were connected through holes made in the green sheet.

(Formation of Magnetic Layer)

A slurry was obtained by mixing and kneading 200 parts by weight of magnetic material (ferrite), 300 parts by weight of solvent, 200 parts by weight of binder, and dispersant and plasticizer, and a green sheet was obtained from this slurry using the doctor blade method. $ZrO_2$ balls, $Al_2O_3$ balls, etc., can be used as a mixing medium, and $ZrO_2$ balls were used in this example. Polyvinyl butyral resin, methacrylate resin, etc., can be used as binder, for example, and polyvinyl butyral resin was used in this example. Dibutyl phthalate, dioctyl phthalate, etc., can be used as plasticizer, for example, and dibutyl phthalate was used in this example. Ethanol, toluene, methyl ethyl ketone, etc., can be used as solvent, for example, and ethanol was used in this example.

(Lamination and Sintering)

Laminate structures were constituted as described below, and then pressure-bonded and degreased in an atmosphere of air, after which the bonded layers were heated to 900° C. at a rate of temperature rise of 600° C./hr in an atmosphere of air and then held at this temperature for 2 hours, followed by cooling, to form a sintered laminate (0.6 mm×0.5 mm×0.5 mm).

Ferrite sheet thickness: 54 μm×4 sheets

Glass sheet thickness: 14.5 μm×2 sheets

Number of planar coil windings: 5 t per layer×2 layers×2 circuits

Pitch between conductors constituting the product: 15 μm (equivalent to 2 sintered sheets)

An Ag paste was applied to the ends of the sintered laminate, after which the coated laminate was baked and then Ni/Sn-plated to obtain a common mode choke coil.

(Evaluation of Mg Segregation)

A randomly selected section of a region of the glass layer in the obtained common mode choke coil was observed with an electron microscope. To be specific, the EPMA mentioned above was used to check whether Mg segregation was present or absent, and the result of an imaging analysis conducted using a TEM was used to check/calculate the ratio of the area occupied by Mg segregation as well as the size of Mg segregation.

(Evaluation of Bubbles)

When the glass layer was evaluated using the EPMA mentioned above, bubbles observed in a randomly selected region of 0.1 mm×0.1 mm and having a long side of 1 μm or more were counted. A section of the glass layer was observed with a SEM and the maximum size of bubbles was measured based on the long sides of bubbles observed in a randomly selected region of 0.1 mm×0.1 mm.

(Evaluation of Moisture Resistance)

To conduct a moisture load test on the obtained common mode choke coils, the 20 products to be measured were impressed with a voltage of 10 V for 1,000 hours under the conditions of 85° C. and 85% humidity to measure their resistance, and if any one product exhibited a measured resistance of below 100 MΩ, a "NG" evaluation was given.

The manufacturing conditions and evaluation results are shown in Table 1.

TABLE 1

| | Material | | Constitution | | Observed result | | Evaluation result |
|---|---|---|---|---|---|---|---|
| | Amount of MgO added [wt %] | MgO particle size [nm] | Area ratio of Mg segregation [%] | Size of Mg segregation [μm] | Number of bubbles [bubbles] | Size of bubbles [μm] | Moisture load test (1,000 hr) |
| Comparative Example 1 | 0.1 | 1000 | 0 | 0 | 32 | 20 | NG |
| Example 1 | 0.5 | 1000 | 0.5 | 0.3 | 9 | 8.2 | OK |
| Example 2 | 2 | 50 | 1.0 | 0.2 | 5 | 2 | OK |
| Example 3 | 2 | 100 | 1.9 | 1.1 | 6 | 3.1 | OK |
| Example 4 | 2 | 500 | 2.2 | 4.2 | 5 | 5.0 | OK |
| Example 5 | 12 | 500 | 12.5 | 6 | 4 | 2 | OK |
| Example 6 | 15 | 100 | 14.9 | 2.5 | 5 | 2.1 | OK |
| Example 7 | 15 | 500 | 15.1 | 10 | 3 | 3.3 | OK |
| Example 8 | 17 | 50 | 16.0 | 11.5 | 5 | 9.1 | OK |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2013-054296, filed Mar. 15, 2013, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A common mode choke coil comprising:

a nonmagnetic layer made of glass, magnetic layers placed in a manner sandwiching the nonmagnetic layer, and two or more coil conductors embedded in a base material constituted by the nonmagnetic layer and the magnetic layers, wherein Mg segregation is present in the nonmagnetic layer and the Mg segregation accounts for 0.5 to 16 percent of the total area as observed on an electron micrograph of a section of the nonmagnetic layer, wherein Mg segregation is an aggregation of Mg which is not introduced as part of the glass, but which exists independently of the glass, and a size of the Mg segregation is 0.2 to 10 μm.

2. A common mode choke coil according to claim 1, wherein the nonmagnetic layer, the magnetic layers, and the coil conductors are simultaneously sintered.

3. A common mode choke coil according to claim 1, wherein the nonmagnetic layer is constituted by borosilicic acid glass, quartz, and Mg.

* * * * *